US007019708B2

(12) United States Patent
Regala

(10) Patent No.: US 7,019,708 B2
(45) Date of Patent: Mar. 28, 2006

(54) PORTABLE CO-LOCATED LOS AND SATCOM ANTENNA

(75) Inventor: Florenio Regala, Costa Mesa, CA (US)

(73) Assignee: Florenio Pinili Regala, Costa Mesa, CA (US)

( * ) Notice: Subject to any disclaimer, the term of this patent is extended or adjusted under 35 U.S.C. 154(b) by 10 days.

(21) Appl. No.: 10/821,780

(22) Filed: Apr. 8, 2004

(65) Prior Publication Data

US 2005/0237256 A1 Oct. 27, 2005

(51) Int. Cl.
*H01Q 21/00* (2006.01)

(52) U.S. Cl. ..... 343/844; 343/839; 343/761

(58) Field of Classification Search ..... 343/761, 343/763, 790, 791, 792, 834, 839, 882, 844, 343/876; H01Q 21/00
See application file for complete search history.

(56) References Cited

U.S. PATENT DOCUMENTS

| | | | | |
|---|---|---|---|---|
| 3,579,244 A | | 5/1971 | Dempsey et al. | |
| 3,665,478 A | | 5/1972 | Dempsey | |
| 5,317,327 A | | 5/1994 | Piole | |
| 5,469,181 A | * | 11/1995 | Yarsunas | 343/815 |
| 5,539,419 A | * | 7/1996 | Ogawa et al. | 343/761 |

FOREIGN PATENT DOCUMENTS

| | | |
|---|---|---|
| EP | 1 494 318 | 1/2005 |
| JP | 7-94940 | 4/1995 |
| WO | WO 01/80366 | 10/2001 |
| WO | WO 03/079561 | 9/2003 |
| WO | WO 04/042938 | 5/2004 |

OTHER PUBLICATIONS

Search Report dated Aug. 2, 2005 for UK Patent Application No. GB0506974.5.

* cited by examiner

*Primary Examiner*—Hoanganh Le
(74) *Attorney, Agent, or Firm*—Scott D. Smiley; Fleit, Kain, Gibbons, Gutman, Bongini & Bianco P.L.

(57) ABSTRACT

A dual-band, dual-polarization LOS/SATCOM antenna having a plurality of omnidirectional elements surrounding a directional element. When the antenna is in an omnidirectional radiating mode, the directional element is disconnected from the circuit and only the omnidirectional elements radiate. The directional element has radiators at one end. When the antenna is in a directional mode, the omnidirectional elements fold out to be perpendicular to the transmission axis and serve as reflectors for the driving radiators, which also fold to be perpendicular to the transmission axis. The radiators and elements are adjustable in length to provide added gain.

25 Claims, 4 Drawing Sheets

PORTABLE CO-LOCATED LOS AND SATCOM ANTENNA

BACKGROUND OF THE INVENTION

1. Field of the Invention

This invention relates in general to antennas and more particularly, to mult-band, multi-function antennas.

2. Description of the Related Art

In civilian life, wireless communication has become a luxury many feel they can't live without. In military operations, that may literally be true. In the field, soldiers must be able to communicate reliably and efficiently with others on the land, in the air, sea, and on the opposite side of the world. Wireless communication is accomplished through use of a radio, which is well known by those having ordinary skill in the art, connected to a radiating element, or antenna, also well know by those having ordinary skill in the art. An antenna is an impedance-matching device used to absorb or radiate electromagnetic waves. The function of the antenna is to "match" the impedance of the propagating medium, which is usually air or free space, to the source. Radio signals include voice communication channels, data link channels, and navigation signals.

Communication with those on the ground is most easily accomplished with radiating elements commonly called "monopoles" or "dipoles." A dipole has two elements of equal size arranged in a shared axial alignment configuration with a small gap between the two elements. Each element of the dipole is fed with a charge 180 degrees out of phase from the other. In this manner, the elements will have opposite charges and common nulls. A monopole, in contrast, has only one element, but operates in conjunction with a ground plane, which mimics the missing second element. The physics of monopoles and dipoles are well known. Monopoles and dipoles, however, are efficient only for line-of-sight (LOS) communication. Obstructions such as mountains, or great distances, relative to the curve of the earth's surface, between the transmitter and receiver can prevent the reception of these signals. The relative positions of the transmitter and receiver, as well as the power output of the transmitter thus control whether the LOS signal will be received.

To overcome the effect of LOS obstacles, satellite communication (SATCOM) has been developed. Satellites are transceivers that orbit the Earth and can relay communications back and forth from the Earth's surface or to other satellites, allowing communication virtually anywhere in the world.

One of the characteristics of antenna transmission is "polarization," which describes what physical plane the signal is being transmitted in. A dipole or monopole oriented in a vertical position (perpendicular to the earth's surface) radiates signals with a vertical polarization. For a second antenna to receive maximum signal strength, it too must have a vertical orientation. As the receiving antenna is rotated away from vertical, its maximum receive power diminishes until the antenna reaches a horizontal orientation (perpendicular to the transmit antenna), at which time the maximum receive power reaches zero.

Because satellites orbit the earth and transmit to receivers in multiple directions and orientations, single plane transmission is not efficient. Therefore, satellites transmit signals in a "circular" polarization. In this manner, the signal is transmitted in a continuous right-hand rotating orientation. A circularly polarized antenna has two dipoles arranged orthogonal to one another. The dipoles alternate "firing" with a positive charge rotating sequentially around the four individual elements and a negative charge on its axially oppositely aligned second element. When viewed on a three-dimensional time vs. polarization graph, the circularly polarized signal resembles a helix.

Due to the above-mentioned inherent loss in perpendicularly oriented linearly polarized transmitting and receiving antennas, a linearly polarized antenna will suffer from a 50% (3dB) signal loss when receiving satellite communication signals. Thus, a more efficient receiving means is desired.

"Man-Pack" radios are mobile radios designed to be carried or worn on a person. Currently Man-Pack radios are used by Military or Paramilitary soldiers in the field and used on the move or at halt. These radios employ a traditional monopole LOS antenna, which suffer from the above-mentioned inherent 3dB loss due to the polarization losses.

Portable SATCOM antennas, which are directional and circularly polarized, are available, however carrying two separate antennas is cumbersome. In addition, disconnection of the LOS antenna and connection of, and assembly or disassembly of a separate SATCOM antenna is usually burdensome to an excessive degree.

Accordingly, a need exists for a portable, lightweight, efficient, multiple band, multiple polarization, LOS/SATCOM antenna communication system in the form of a single unit that can easily be deployed in the field.

SUMMARY OF THE INVENTION

The present invention antenna system provides a lightweight and easily carried multiple band, multiple polarization antenna communication system. In a directional mode, the antenna system provides a fully capable, directional, antenna system of circular polarization especially suited for satellite communication but usable for other purposes. In an omnidirectional mode the antenna system provides a fully capable, omni-directional, antenna system of vertical polarization especially suited to line-of-sight communication, but usable for other purposes.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF THE PREFERRED EMBODIMENT

Figure 1A:
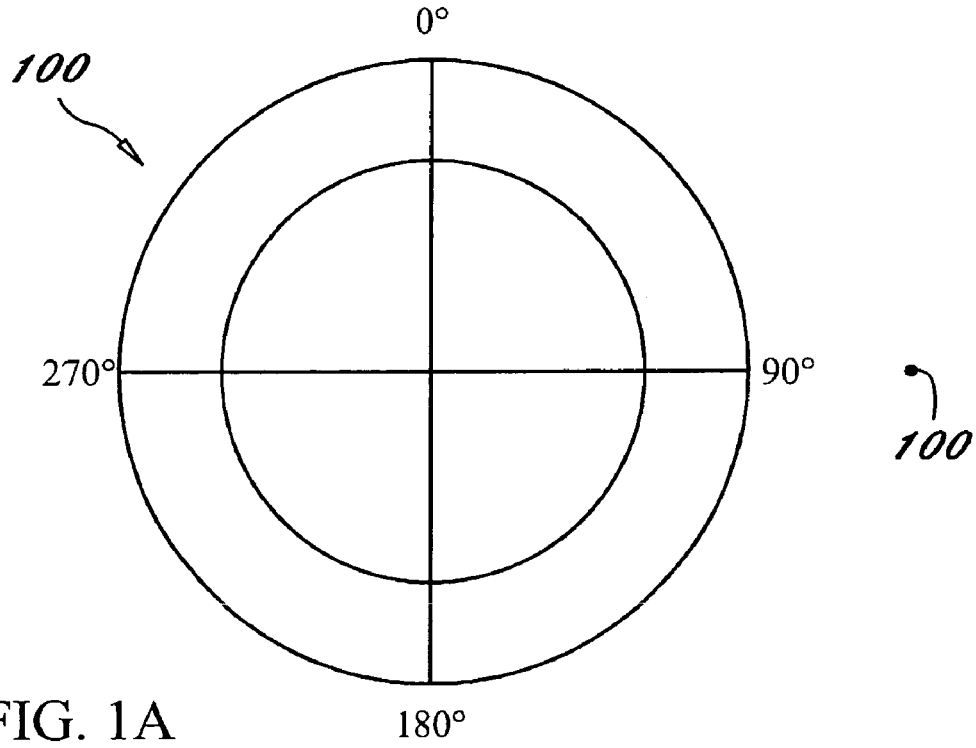
FIG. 1*a* is an elevational-view diagram illustrating the radiation pattern of the inventive antenna in an omnidirectional mode.

While the specification concludes with claims defining the features of the invention that are regarded as novel, it is believed that the invention will be better understood from a consideration of the following description in conjunction with the drawing figures, in which like reference numerals are carried forward.

Figure 1B:
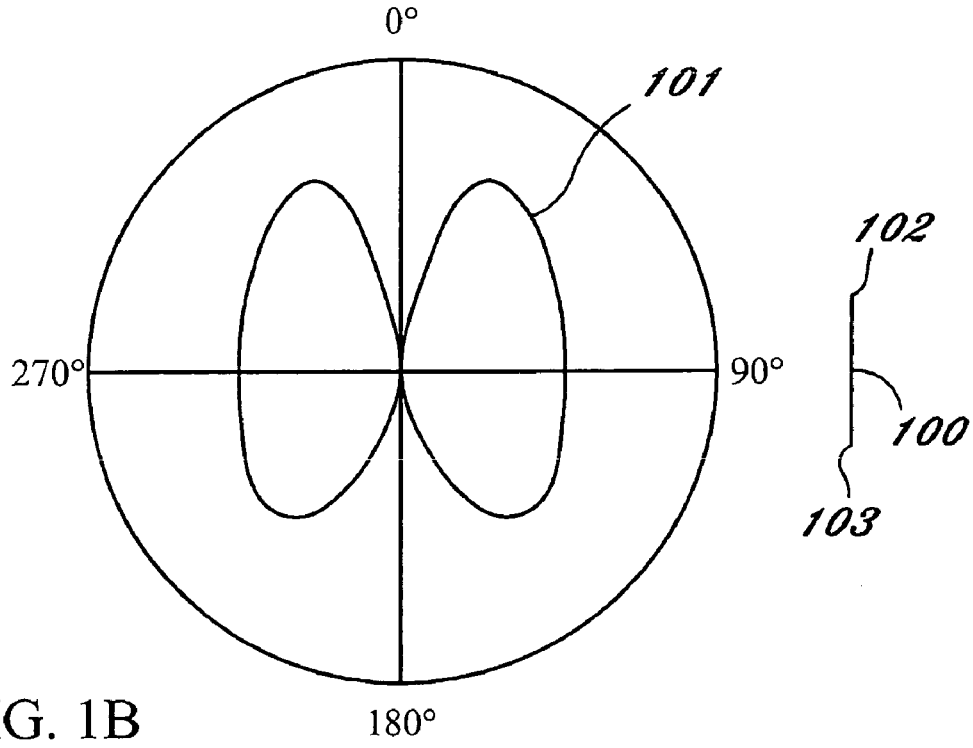
FIG. 1*b* is a side-view diagram illustrating the radiation pattern of the inventive antenna in an omnidirectional mode.

Exemplary Embodiment of a LOS Antenna:

Described now is an exemplary antenna configuration for an omnidirectional vertically polarized communication mode of the inventive multi-band antenna according to an exemplary embodiment of the present invention. With reference to FIGS. 1*a* & 1*b*, a radiation pattern 101 of the inventive antenna 100 in its omnidirectional mode is shown. FIG. 1*a* shows the pattern of the antenna 100 viewed from directly above or below the antenna. FIG. 1*b* shows the pattern of the antenna 100 viewed from the horizon with a first end 102 of the antenna 100 oriented in a direction toward 0 degrees and a second end 103 of the antenna 100 oriented in a direction toward 180 degrees. A dot depicting the orientation of antenna 100 is pictured on the right side of FIG. 1*a* and a line depicting the orientation of antenna 100 is pictured on the right side of FIG. 1*b*.

Referring now to FIG. 1*a*, the top-view radiation pattern 101 of the antenna 100 in its omnidirectional mode is shown. Antenna 100 produces a radiation pattern that is substantially uniform throughout all angles. In this mode, the antenna can communicate equally well laterally in all directions. As previously stated, FIG. 1*b* shows antenna 100 from a horizontal view. This view shows that radiation strength, also called "gain," decreases from a maximum value at approximately 90 degrees and 270 degrees to approximately zero, also called a "null," at approximately 0 degrees and 180 degrees.

Figure 2:
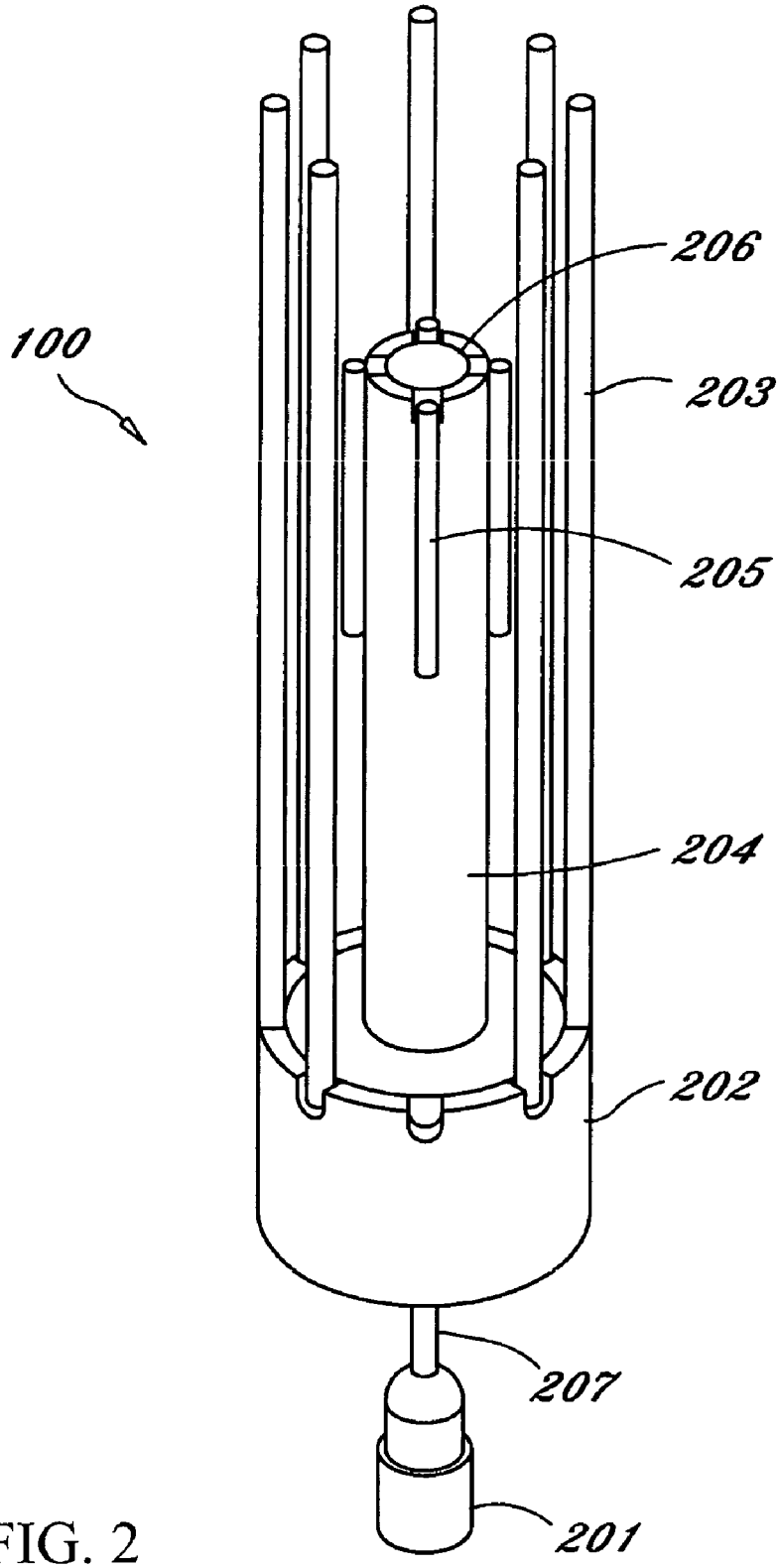
FIG. 2 is a diagram illustrating the inventive antenna in an omnidirectional LOS configuration.

Antenna 100 is shown in its omnidirectional configuration mode in FIG. 2. Antenna 100 includes a radio/antenna interface 201 connected to the antenna body 202, which holds a group of four or more omnidirectional elements 203, which surround a directional element 204. The directional element 204 is provided with four dipoles 205 attached at an end of the element furthest away from the body 206, 202. The omnidirectional elements 203 may be telescoping to maximize performance, which is dependent on the length of the elements 203 at various frequencies When the antenna 100 is in the omnidirectional mode, an electrical path is created from the radio/antenna interface 201, through the body 202, to the omnidirectional radiating elements 203. Radio/antenna interface 201 provides an electrical connection from the omnidirectional radiating elements 203 to a radio (not shown).

Figure 3:
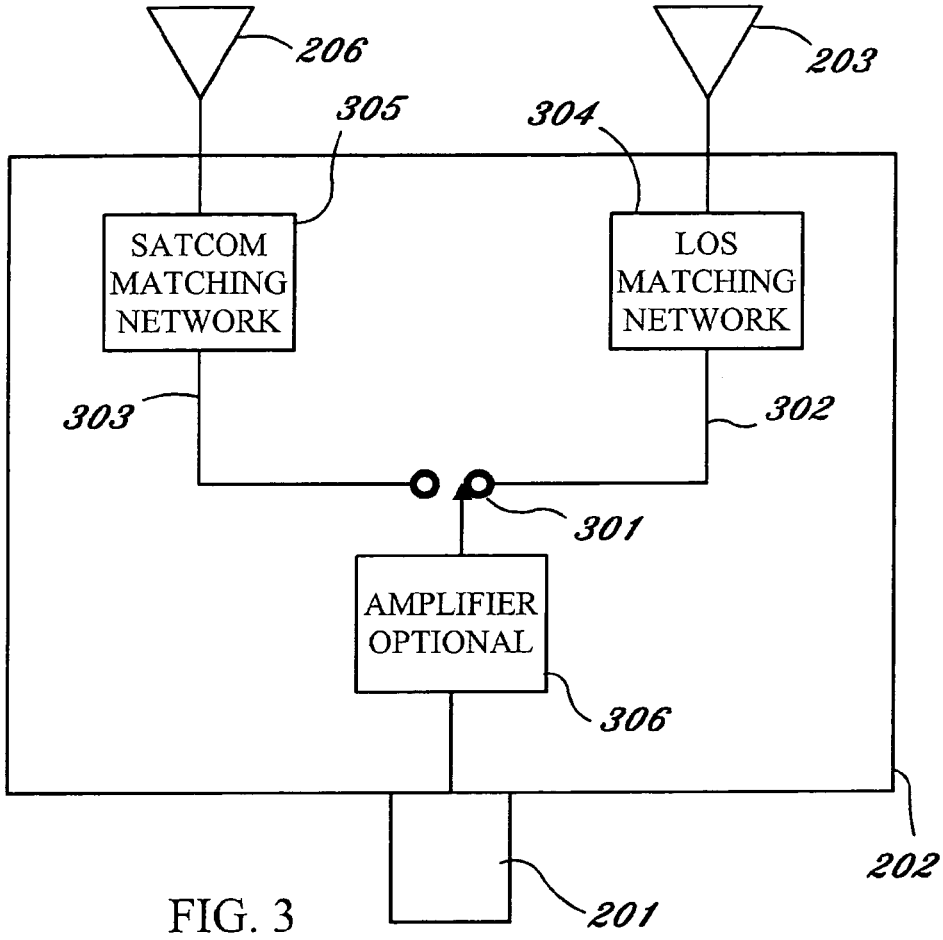
FIG. 3 is a block diagram illustrating the antenna circuit.

FIG. 3 shows a switch 301 for selecting between an omnidirectional mode (LOS) 302 or a directional mode (SATCOM) 303 of the antenna 100. In one embodiment, the switch 301 is a single pole double throw switch (SPDT), which can be manual, coaxial, or a PIN diode switch. However, other switching devices capable of selecting one of two electrical pathways may be utilized without departing from the spirit of the invention.

When the antenna is in the omnidirectional mode 302, the omnidirectional elements 203 are secured in a position substantially parallel to the directional element 204. However, the antenna 100 may be tuned by varying the omnidirectional elements 203 between parallel and horizontal to the directional element 204. The omnidirectional elements 203 are excited via an electrical path from the radio/antenna interface 201 through switch 301 to the omnidirectional elements 203. In this configuration, when a radio (not shown) is connected to the antenna 100 through the radio/antenna interface 201, a monopole antenna is realized. In this mode, the radio acts as the ground plane. In this manner, a vertically polarized, omnidirectional signal is transmitted and/or received.

For the most efficient radiation and reception of RF signals, as shown in FIG. 3, an impedance matching circuit 304 is provided between the radio/antenna interface 201 and the omnidirectional radiating elements 203. Likewise, an impedance matching circuit 305 is provided between the radio/antenna interface 201 and the directional element 206. The matching circuit 305 includes a quadrature hybrid and a terminating load. The matching circuit 304 includes inductive and capacitive elements. Impedance matching is well known in the art; therefore, impedance matching and particulars of such circuits will not be further discussed herein.

FIG. 3 also shows an amplifier 306 located between the radio/antenna interface 201 and the switch 301. The amplifier 306 is advantageously used to provide a signal gain, but is not necessary for the inventive antenna to function either as an omnidirectional or directional antenna. RF amplifiers are well know by those having ordinary skill in the art and is not, therefore, discussed in detail.

Referring again to FIG. 1*b*, it can be seen that due to amplitude degradation as the angle approaches 0 and 180 degrees, it may be desirable to adjust the angle of the antenna 100, with reference to the horizontal plane, in the field to provide maximum transmission signal gain. In one embodiment of the invention, the radio/antenna interface 201 is able to swivel to enable the operator to change the orientation of the antenna while keeping the radio in a static position. In another embodiment, as shown in FIG. 2, flexible tubing 207 can be used to accomplish the same result. As the antenna angle is adjusted, the tubing 207 can bend and the radio can remain stationary. Similarly, there are numerous other methods of connecting the antenna 100 to a radio while maintaining the ability to adjust the position of the antenna relative to the radio without need for disconnecting the radio.

Exemplary Embodiment of a SATCOM Antenna

Figure 4:
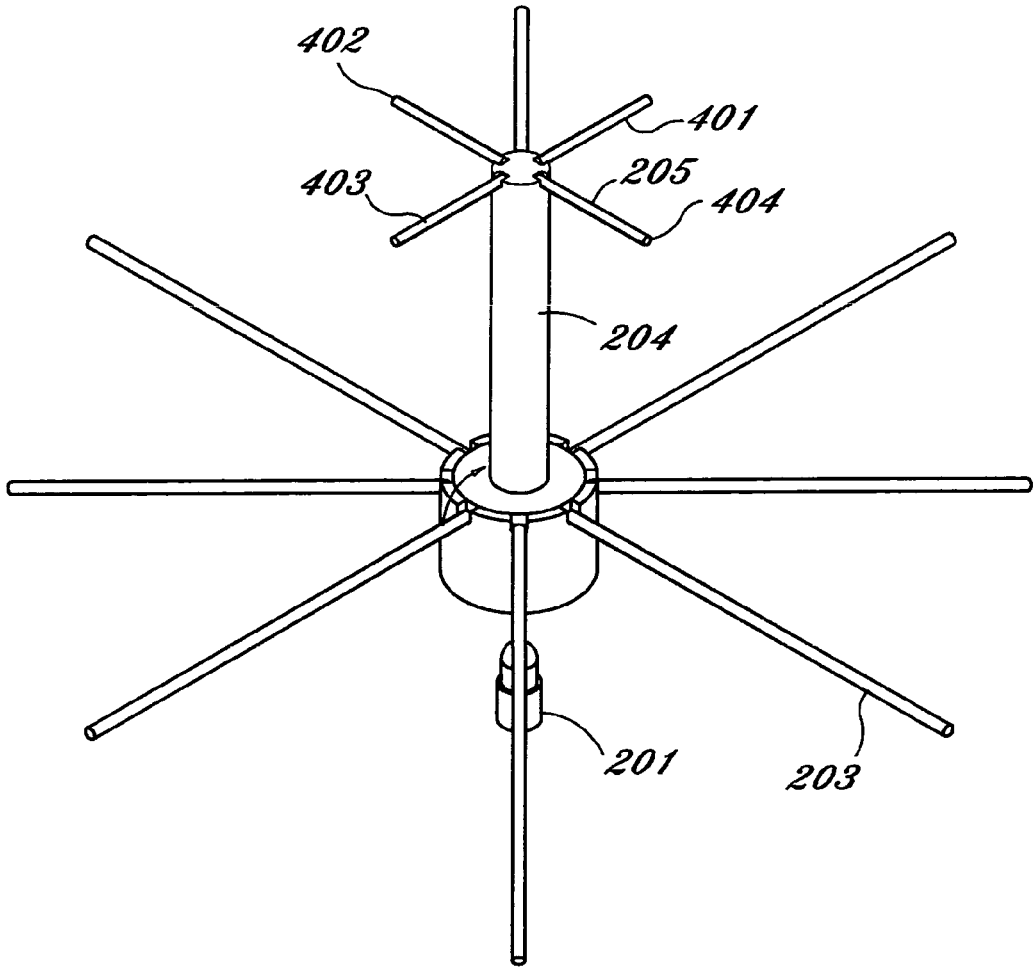
FIG. 4 is a diagram illustrating the antenna in a directional SATCOM configuration.

In a second configuration, the directional mode of the antenna 100, the antenna 100 will be physically converted to a directional antenna. To accomplish the conversion, omnidirectional elements 203 will be repositioned, as shown in FIG. 4, to lie in a plane perpendicular to directional element 204. Additionally, radiators 205 will also be repositioned to lie in a plane substantially perpendicular to directional element 204, also shown in FIG. 4. In this configuration, and after switch 301 has disconnected the omnidirectional elements 203 from the radio, the omnidirectional elements 203 serve as reflectors for the radiators 205. The reflectors 203 reflect energy, creating a directional radiation pattern, thus increasing the SATCOM antenna gain. The antenna gain maybe varied by adjusting the length (shorter or longer) of the reflectors 203. The omnidirectional elements 203 therefore, have two functions: to serve as radiating elements for the LOS omnidirectional mode, and when deployed, as an antenna reflector for the SATCOM directional mode.

Figure 5:
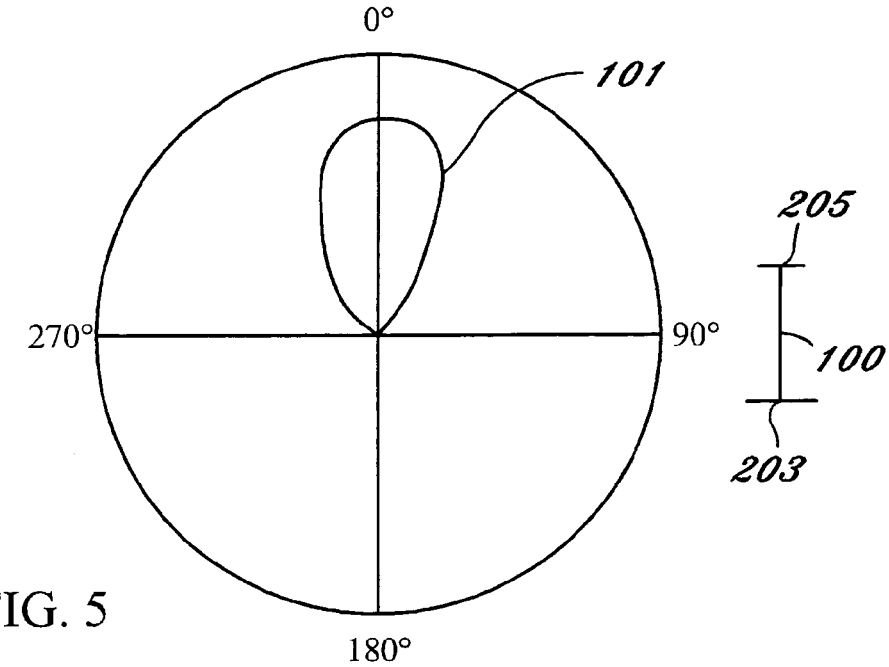
FIG. 5 is an elevational-view diagram illustrating the radiation pattern of the inventive antenna in a directional mode.

Referring now to FIG. 5, the directional radiation pattern of the antenna 100 in its directional configuration mode is shown. FIG. 5 shows the pattern of the antenna 100 viewed from the horizon with a first end of the antenna oriented in a direction toward 0 degrees and a second end of the antenna oriented in a direction toward 180 degrees. A line depiction showing the orientation of antenna 100 is pictured on the right side of FIG. 5. To further clarify the illustration, the reflectors 203 and radiators 205 are labeled. A directional transmission axis is defined as the line running from 0 degrees to 180 degrees.

As can clearly be seen in the FIG. 5, the gain 101 of the antenna 100 in its directional mode reaches its maximum value at approximately 0 degrees. The gain value 101 decreases as the angle is varied from 90 degrees until finally a null is reached somewhere between 0 degrees and 90 degrees. Thus, maximum gain is realized in only a single direction when in the directional mode.

The radiators 205 are shown in FIG. 4 as four separate elements 401, 402, 403, and 404. The four separate elements 401, 402, 403, and 404 form two orthogonal dipole antennas, with 401 and 403 forming the first dipole and 402 and 404 forming the second. Each dipole 401, 403 & 402, 404 is alternately energized with opposing charges when the antenna is in the directional mode and results in a circularly polarized signal being transmitted. Specifically, at a time 1, a positive charge is applied to element 401, the same negative charge will be applied to element 403. At time 2, a positive charge will be applied to element 404 and a corresponding negative charge to element 402. At time 3, a positive charge will be applied to element 403, with the corresponding negative charge applied to element 401. Finally, to complete one rotation, a positive charge is applied to element 402 and a corresponding negative charge is applied to element 404. In this manner, a positive charge can be visualized rotating around the circumference of directional element 204, in the order 401, 404, 403, and 402.

The portion of the output wave launched by the radiators 205 that reaches reflectors 203 is reflected back in a direction toward the radiators 205 and added to the output wave already traveling in the direction away from the reflectors 205. As a result, the antenna 100 in its directional mode outputs little or no energy in the area behind the reflector, thereby creating a directional circularly polarized output signal.

Additional gain can be realized by providing additional radiators to the end of directional element 204. Additionally, the radiators 205 and omnidirectional elements 203 can be repositioned, or "folded" and "unfolded," through the use of pivoting joints, springs, hinges, removal and insertion into another insertion port, or one of many other methods of repositioning and reorienting an element. It is desirable that an electrical connection be maintained to the elements 103 and 105 throughout a lifecycle of many folds and unfolds of the elements 103 and radiators 105. Finally, all elements and radiators can advantageously telescope to reduce the size of the assembly.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An antenna assembly comprising:

an antenna/radio interface;

a body section connected to the antenna/radio interface; and a plurality of omnidirectional radiating elements connected to the body section and surrounding a directional radiating element assembly, the group of omnidirectional radiating elements having a first position within the body section for an omnidirectional mode of the antenna assembly and a second position within the body section for a directional mode of the antenna assembly.

2. The antenna assembly according to claim 1, further comprising a switch for selecting between one of the omnidirectional mode and the directional mode of the antenna assembly.

3. The antenna assembly according to claim 1, wherein the body section includes:

a switch for selecting between one of the omnidirectional mode and the directional mode of the antenna assembly; and at least one matching circuit.

4. The body section according to claim 3, further comprising an amplifier.

5. The antenna assembly according to claim 1, further comprising the omnidirectional radiating elements being arranged perpendicular to a directional transmission axis of the antenna and serving as a reflector for the directional radiating element assembly when in the directional mode.

6. The antenna assembly according to claim 1, further comprising the antenna/radio interface being a coaxial cable connector.

7. The antenna assembly according to claim 1, further comprising the omnidirectional mode being an electrical connection between the group of omnidirectional radiating elements and the antenna/radio interface.

8. The antenna assembly according to claim 1, further comprising the group of omnidirectional radiating elements includes at least two elements.

9. The antenna assembly according the claim 8, further comprising the group of omnidirectional radiating elements having an adjustable length.

10. An antenna assembly comprising:

an antenna/radio interface;

a body section connected to the antenna/radio interface; and a group of omnidirectional radiating elements connected to the body section and surrounding a directional radiating element assembly, the group of omnidirectional radiating elements having a first position within the body section for an omnidirectional mode of the antenna assembly and a second position within the body section for a directional mode of the antenna assembly, wherein the directional radiating element assembly includes an elongated section having a first end and a second end with the first end connected to the body section of the antenna assembly and the second end having two radiators.

11. The antenna assembly according to claim 10, further comprising the directional mode being an electrical connection between the directional radiating element assembly and the antenna/radio interface.

12. The antenna assembly according to claim 10, further comprising the two radiators being a first radiator having a first dimension and a second radiator having a second dimension, defining a plane perpendicular to the transmission axis when the antenna assembly is in the directional mode.

13. The antenna assembly according to claim 10, further comprising the two radiators being parallel with a directional transmission axis of the antenna when the antenna assembly is in the omnidirectional mode.

14. The antenna assembly according to claim 10, further comprising the two radiators having an adjustable length.

15. A dual-band antenna comprising at least one omnidirectional radiating element and a directional radiating element located on a body section, with the directional radiating element having at least two radiators and the body section having a first position for deploying a plurality of reflectors and a second position for storing a plurality of reflectors, wherein the reflectors only function as reflectors when in the first position.

16. The dual-band antenna according to claim 15, further comprising the at least one omnidirectional radiating element having a first position within the body section for an omnidirectional mode of the antenna and a second position within the body section for a directional mode of the antenna.

17. The dual-band antenna according to claim 16, wherein the omnidirectional mode is an electrical connection between the at least one omnidirectional radiating element and an input/output interface and the directional mode is an electrical connection between the directional radiating element and an input/output interface.

18. The dual-band antenna according to claim 15, further comprising the radiators being arranged perpendicular to a directional transmission axis for a directional mode of the antenna and parallel to a directional transmission axis for an omnidirectional mode of the antenna.

19. The dual-band antenna according to claim 18, wherein the omnidirectional mode is an electrical connection between the at least one omnidirectional radiating element and an input/output interface and the directional mode is an electrical connection between the directional radiating element and an input/output interface.

20. The dual-band antenna according to claim 15, further comprising the at least one omnidirectional radiating element being arranged perpendicular to a directional transmission axis and serving as a reflector for the directional radiating element when the antenna assembly is in a directional mode.

21. The dual-band antenna according to claim 20, wherein the directional mode is an electrical connection between the directional radiating element and an input/output interface.

22. The dual-band antenna according to claim 15, further comprising the body section including at least one matching circuit and a switch.

23. The dual-band antenna according to claim 22, further comprising the body section including at least one amplifier.

24. The dual-band antenna according to claim 15, further comprising the elements being adjustable in length.

25. The dual-band antenna according to claim 15, further comprising the at least two radiators being adjustable in length.

* * * * *